US005610581A

United States Patent [19]

Keller

[11] Patent Number: 5,610,581

[45] Date of Patent: Mar. 11, 1997

[54] COMBINATION BAR LOCK AND ELECTRICAL ALARM SYSTEM FOR DOORS AND WINDOWS

[76] Inventor: Merlin E. Keller, 505 Ramsey St., Monticello, Minn. 55362

[21] Appl. No.: 589,937

[22] Filed: Jan. 23, 1996

[51] Int. Cl.[6] ..... G08B 13/08

[52] U.S. Cl. ..... 340/547; 200/61.93; 340/545

[58] Field of Search ..... 340/545, 547; 200/61.93

[56] References Cited

U.S. PATENT DOCUMENTS

| | | | |
|---|---|---|---|
| 3,797,005 | 3/1974 | Schwarz | 340/545 |
| 4,553,134 | 11/1985 | Holt | 340/545 |
| 4,896,139 | 1/1990 | Eldridge | 200/61.93 |

*Primary Examiner*—Glen Swann
*Attorney, Agent, or Firm*—Roger W. Jensen

[57] ABSTRACT

A window is positioned within a window casing and means are provided for rotatably connecting the window to the casing. A security apparatus includes a pair of rod holding brackets mounted on the casing on opposite sides of the window on an axis spaced from and substantially parallel to the rotational axis, each of the brackets having notch-like means for receiving and holding the end of a rod. An elongated rod is supported by the brackets and a permanent magnet is provided at one end of the rod to co-act with a magnetically operable switch attached to one of the brackets, the switch being connected to an alarm. When the window is closed the rod is positioned and held by the brackets and the permanent magnet causes the switch to have a first condition. The rod prevents the window from being moved from the closed position to the open position. If the rod is removed from the brackets, then the movement of the magnet away from the switch causes a change in condition of the switch to actuate the alarm.

15 Claims, 5 Drawing Sheets

COMBINATION BAR LOCK AND ELECTRICAL ALARM SYSTEM FOR DOORS AND WINDOWS

BACKGROUND OF THE INVENTION

The field of this invention is building security and more specifically providing a single means for signalling an alarm if a window or door is opened, the foregoing being a first function and a second function being the provision of a mechanical means such as a bar to prevent the window or door from being opened.

An example of the prior art is U.S. Pat. No. 4,553,134 which teaches apparatus for signalling an alarm; the apparatus comprises a telescoping rod that is positioned inside a window casing and if the rod is moved, e.g., by a burglar, then an alarm will be actuated. U.S. Pat. No. 4,553,134 shows an electrical alarm system comprising a rod inserted into a tube in telescope fashion, the rod having a compression spring for removably affixing the rod and tube within the casing of a window or a door. The rod has sensor means connected in a closed circuit to an alarm means and when the spring loaded rod and tube assembly is jarred or moved, then the sensor means opens or closes the circuit and the alarm means sounds. While this patent teaches an alarm function, it does not teach the separate and important function of having a bar that will mechanically resist the opening of the window or door.

Prior art patents include those patents cited as references for U.S. Pat. No. 4,553,134. None of these prior art patents teach a dual function apparatus of the present invention.

SUMMARY OF THE INVENTION

The present invention provides a security apparatus adapted to be connected to an alarm means of a building alarm system. More specifically, the present invention provides a combination bar lock and electrical alarm system for doors and windows. The security apparatus provides a two part security for a window (or a door) movably positioned in a wall of a building having a window or door casing. One embodiment of my invention is applicable to windows which are rotatably connected to a window casing so that the window may be selectively rotated about a rotational axis from a closed (and usually locked) position to an open position. The security apparatus of my invention comprises a pair of rod holding brackets mounted, respectively, on the window casing on opposite sides of the window on an axis spaced from and substantially parallel to the window rotational axis. Each of the brackets includes means for receiving and holding the end of a rod. A rod is provided of a preselected length so that it is supported at each end by the receiving and holding means of the brackets. A magnet means is integrally attached to one of the ends of the rod and magnetically operable switch means is provided in one of the brackets, the switch means being adapted for connection with the alarm means of the building alarm system. My invention is further characterized by having the rod positioned, when the window is in the closed position, so that the ends of the rod are positioned respectively on the brackets and are engaging the receiving and holding means and further with the magnet means positioned in magnetic proximity with the switch means to thereby cause the switch means to have a first condition. This arrangement provides two functions. First, the rod, when positioned as aforesaid, prevents the window from being moved from the closed position to an open position. Second, if the rod is removed from the brackets so that the magnet means is moved away from the switch means, then this will cause a change in condition of the switch means from the first condition to a second condition to thereby actuate the alarm means of the alarm system. As an example, if a burglar found an unlocked window, e.g., a basement-type window, and tried to rotate such window about its pivotal axis, the rod would provide a mechanical obstruction preventing the rotation of the window sufficient to permit the entry of the burglar. If the burglar broke the glass of the window and thereafter removed the rod from the brackets, then this would trigger the alarm system. This concept may also be used in combination with windows and doors that are sliding with respect to the building wall as opposed to rotating.

DETAILED DESCRIPTION OF THE INVENTION

Figure 1:
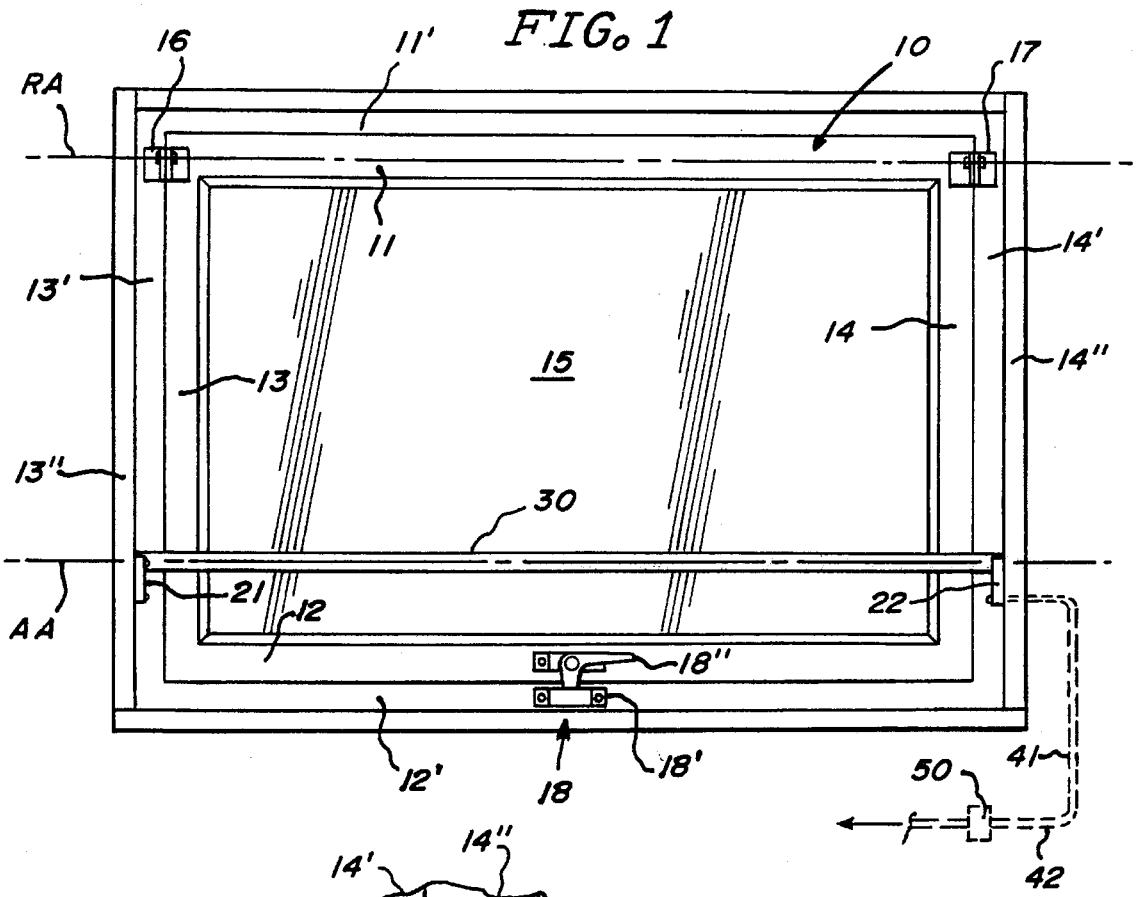
FIG. 1 is a plan or elevational view of a window having a horizontal rotational support means in combination with a preferred embodiment of my invention.

Referring to FIG. 1, reference numeral 10 designates a "basement-type" window having a frame (usually made of wood) with a top member 11, a bottom member 12, and side members 13 and 14 arranged to define a rectangle and supporting a window pane 15. A window casing is provided and is designated by reference numerals 11' and 12' on the top and bottom. The side casing members are designated by reference numerals 13' and 14' (for the casing members immediately adjacent, respectively, to sides 13 and 14 of the window) and outer casing members 13" and 14".

The window 10 is supported and positioned within the window casing as depicted and the window is adapted to be rotated with respect to the casing about a horizontal rotational axis or movable axis RA, this axis being defined by a pair of hinges 16 and 17. As shown in FIG. 1, hinges 16 and 17 respectively have one part attached to window elements 13 and 14 and a second part connected to casing members 13' and 14'. As shown the hinges 16 and 17 are positioned near the upper corners of the window frame.

Figure 2:
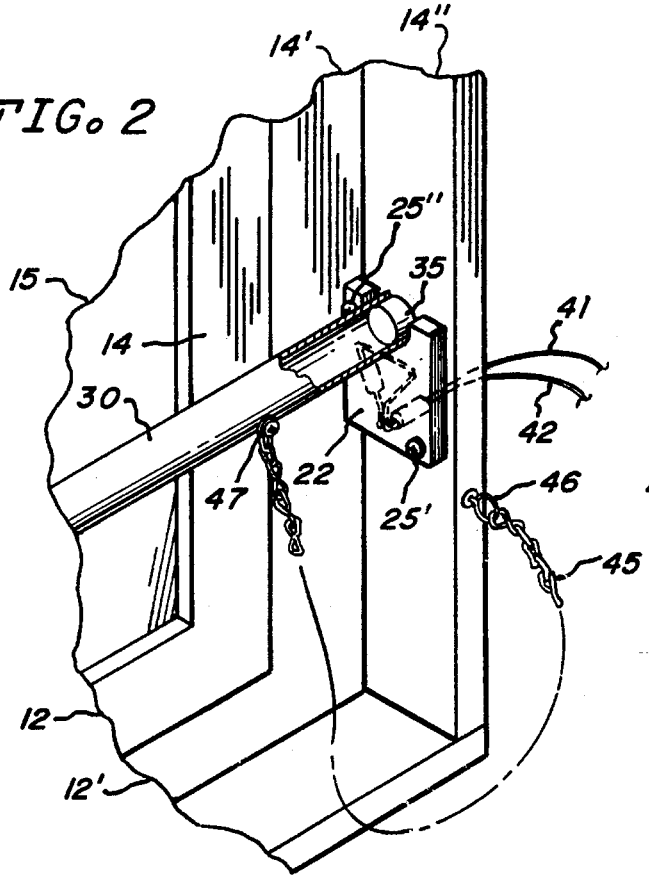
FIG. 2 is an isometric view of a portion of the apparatus shown in FIG. 1, enlarged to show more detail.
Figure 3:
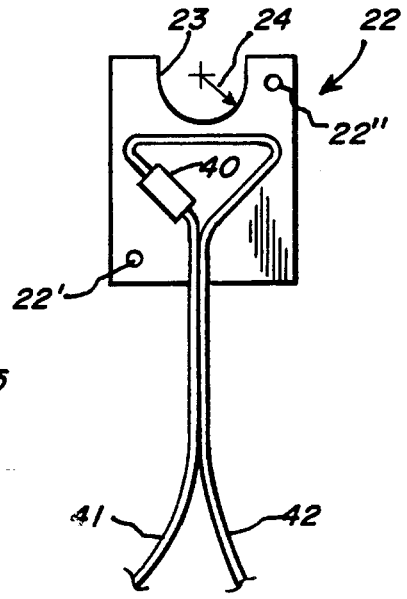
FIG. 3 is an enlarged elevational view of one of the brackets used in the apparatus of FIG. 1.

A pair of rod holding brackets 21 and 22 are provided and are mounted, respectively, on window casing portions 13" and 14" adjacent to a rod axis AA spaced from and substantially parallel to the rotational axis RA. Brackets 21 and 22 are substantially identical in size and shape, the only significance difference being that bracket 22 includes switch means to be described below. Bracket 22 is shown in more detail in FIGS. 2 and 3; it is a square-shaped member having a preselected thickness (shown in FIG. 2) with a rod receiving and holding means 23 provided in the top thereof as shown in FIG. 3. In the preferred embodiment of my invention, the receiving and holding means 23 is in the form of a notch having the lower portion thereof curved about a radius 24 which is substantially the same (or slightly larger) as one half of the diameter of the rod to be described below. A pair of bores 22' and 22"(shown in FIG. 3) are provided in opposite corners of the bracket to facilitate the attachment of the bracket 22 to the window casing portion 14" by use of screws 25' and 25", respectively, as shown in FIG. 2.

An elongated rod 30 is provided, having a preselected length so that the rod may be supported at each of its ends by the receiving and holding means 23 of the brackets 21 and 22. In the preferred embodiment the rod has a round cross-section with a diameter preselected so that the rod will snugly fit within the rounded notch 23. It will be understood, for all rod shapes, that the notch profile complements the rod cross-section.

It will be noted that the brackets 21 and 22 are attached to the casing members 13" and 14", respectively, relatively near the bottom portion 12 of the window 10 and, as aforesaid, the brackets are positioned so that the rod axis AA is parallel to the rotational axis RA.

Also shown in FIG. 1 is a well known locking means 18 which is frequently used with this type of window and comprises a first bracket 18' attached to casing 12' and a rotatable lever portion 18" attached to bottom 12 of the window.

FIG. 2 shows the right end of rod 30 cut away; in this embodiment the rod 30 is a hollow metallic tube (such as extruded aluminum having a low magnetic permeability). It will be noted from FIG. 2 that the rod 30 is snugly supported by the notch 23, i.e., the rod receiving and holding means, of the bracket 22.

A permanent magnet means 35, in the form of a disc-shaped magnet, is nested inside and secured to the extreme right end of the hollow rod 30 as shown in FIGS. 1 and 2. As is well known by those skilled in the art, the permanent magnet 35 will produce a significant electromagnetic field that flows between the north and south poles (not shown) of the magnet in the general proximity of the magnet.

A magnetically operable switch means 40 is attached to or embedded in the bracket 22 and the strength of the magnet 35 and the sensitivity of the switch means 40 are preselected so that when the rod 30 is in the position as shown in FIG. 2 the magnetic field from the magnet 35 will cause the switch means 40 to have a first condition (either open circuit or closed circuit, depending on design choice, as those skilled in the art understand). The switch means 40 is adapted to be connected to alarm means 50 by a pair of wires or leads 41 and 42. One source (of many) for the permanent magnet means 35 and the switch means 40 is G.R.I. Telemark Corp. of Kimball, Neb.

When the rod 30 is removed from the brackets so that the magnet means 35 is moved away from the switch means 40, then the magnetic field no longer maintains the switch means at the aforesaid first condition and accordingly the switch means will be changed to a second condition. Thus, for example, if the switch means 40 had been in a closed condition when the rod 30 is in the position as shown in FIG. 2, then when the rod is moved away from the bracket the switch 40 will have an open condition. It is the change in condition that will operate the alarm means 50.

If desired, a link chain 45 or other flexible means such as a cord may be connected between the window casing 14" (as at 46) and the rod 30 (as at 47).

Figure 4:
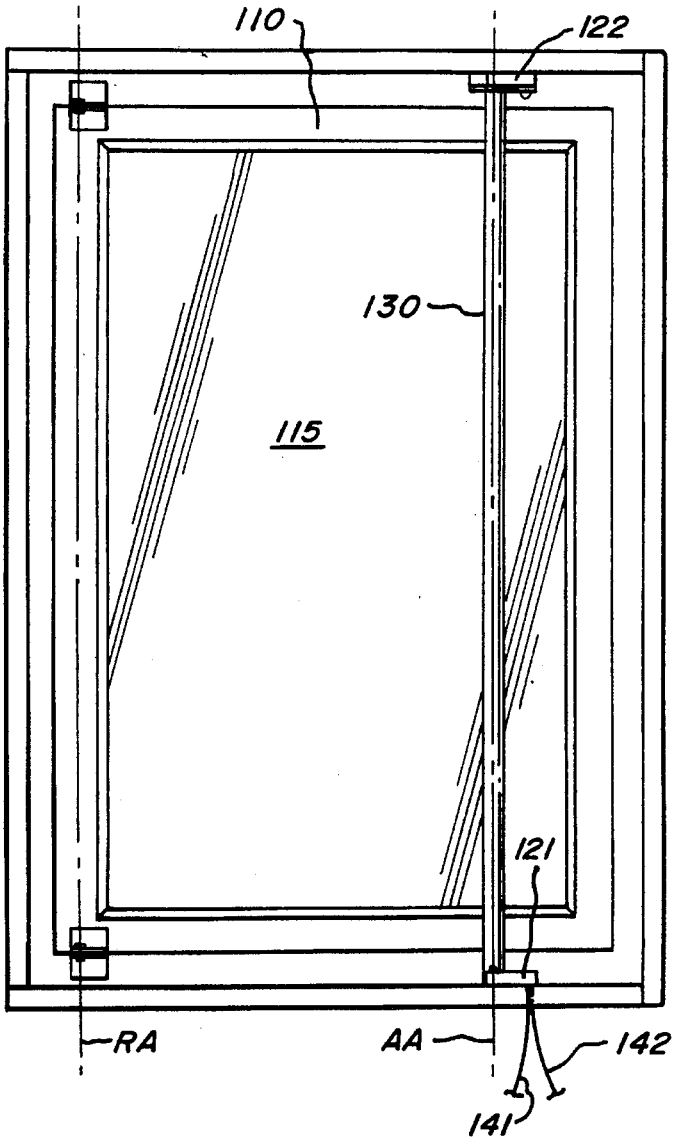
FIG. 4 is another embodiment of the invention shown in combination with a window having a rotational axis which is vertical with respect to the building.
Figure 5:
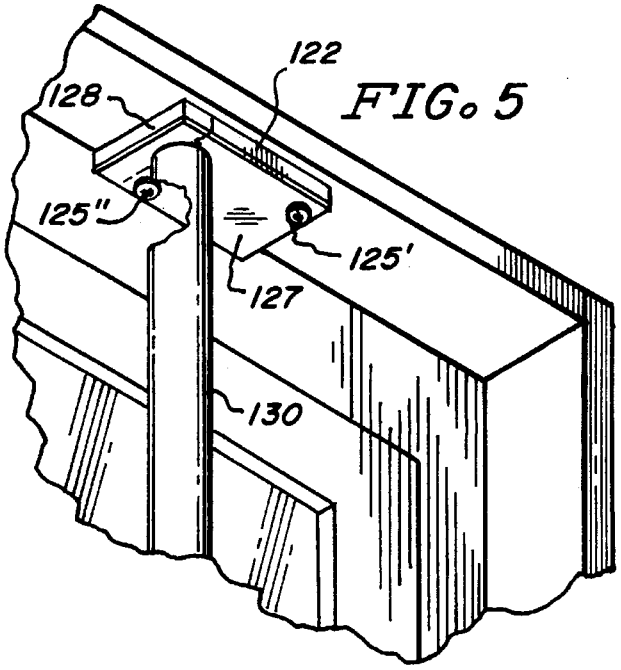
FIG. 5 is an enlarged isometric view of a portion of the apparatus shown in FIG. 4.
Figure 6:
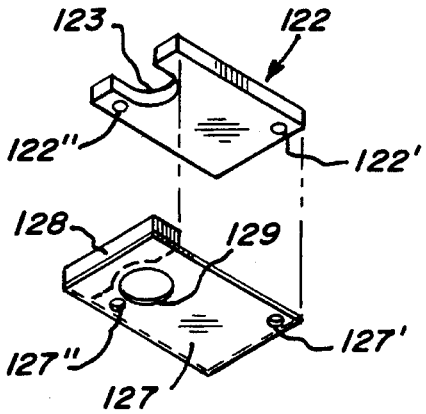
FIG. 6 is an enlarged isometric exploded view of the special bracket used in the apparatus of FIG. 4.

FIGS. 4, 5 and 6 show another embodiment of my invention where there are a number of similarities to the first embodiment depicted in FIGS. 1, 2 and 3. More specifically, the window unit shown in FIG. 1 has, as indicated, a rotational axis RA which is horizontal while the window unit shown in FIG. 4 has a rotational axis RA which is vertical. In FIG. 4 the reference numerals 110 and 115 respectively designate the window and window pane. A rod 130, similar to rod 30 of FIG. 1, has a preselected length so that it fits within the window casing and is positioned in the notches or seats of a pair of brackets 121 and 122 which in general use the same basic bracket structure as shown in FIG. 3, the only significant exception being that the bracket 122 has an auxiliary member 127 (see FIG. 6) rectangular in shape and having at one end thereof a transverse portion 128 of the same thickness as bracket 122. Member 127 also has an aperture or bore 129 therethrough adapted to be in register with the notch 123 when the members 122 and 127 are in flat abutting relationship and as assembled, are fastened to the window casing by appropriate screws 125' and 125" which pass through, respectively, apertures 127' and 122' and 127"/122" in members 127 and 122.

As shown in FIG. 5, the end of rod 130 passes through aperture 129 and this end of the rod is held in position against any gravitational force or other tendency to fall out of the bracket.

A pair of wires 141 and 142 are depicted in FIG. 4 for connection with magnetically operated switch means (not shown) in bracket 121. For this embodiment the rod 130 would have at the bottom end thereof (as shown in FIG. 4) a magnet similar to permanent magnet 35 shown in FIG. 2. The operation of the apparatus of FIGS. 4, 5 and 6 are very similar to that depicted in FIGS. 1–3 in that the rod 130 tends to prevent any significant rotation of the window 115 about the rotational axis RA to thus provide a mechanical protection function. Independently, if the rod 130 were moved out of the bracket so that the lower end of the rod, as shown in FIG. 4, were moved away from bracket 121, this would change the condition of the switch means so as to activate the alarm system.

Figure 7:
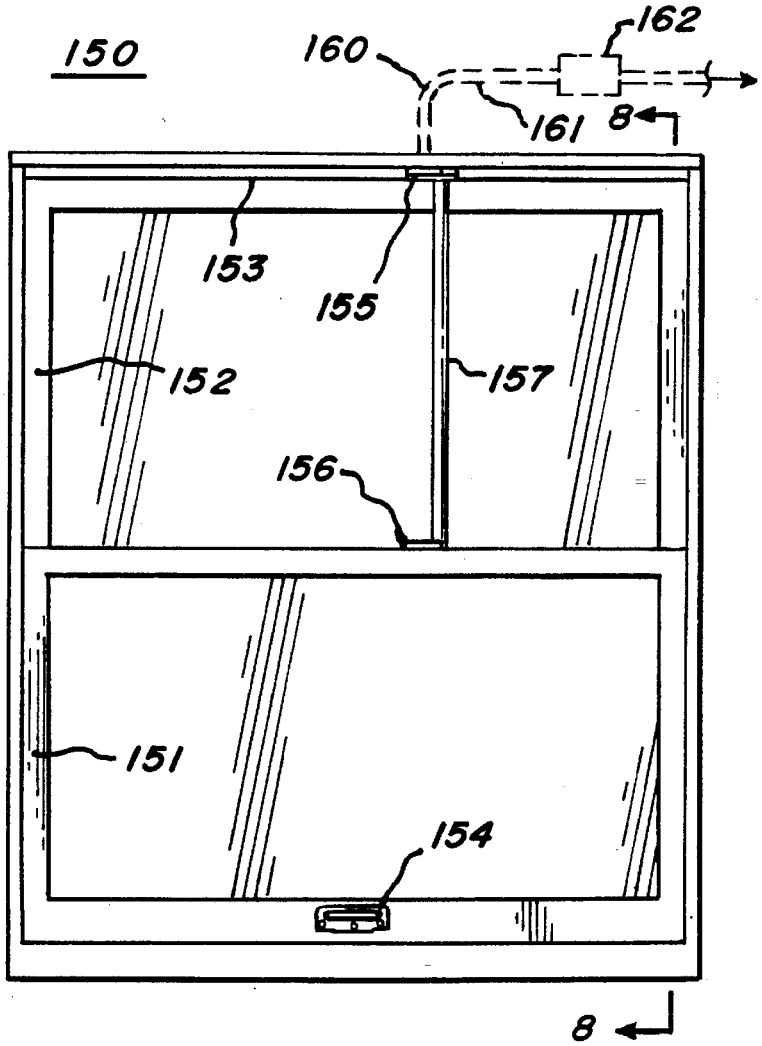
FIG. 7 is a showing of the invention as applied to a double hung window.
Figure 8:
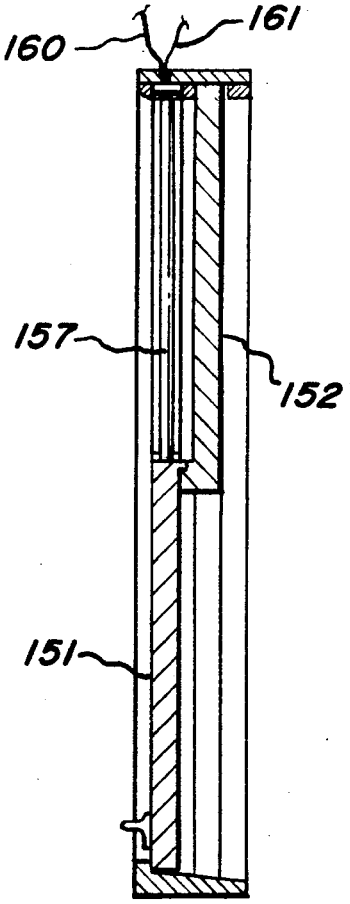
FIG. 8 is a cross-sectional view of the window and apparatus of FIG. 7 as viewed along section lines 8—8 thereof.

FIGS. 7 and 8 show my invention applied to a double hung window 150 which includes a window casing 153 for supporting a lower window unit 151 and an upper window unit 152. Without the security apparatus, the lower window unit 151 may be raised by upward force being applied to a handle means 154. The security apparatus comprises a lower bracket unit 156 similar to the basic bracket 21 shown in FIG. 1 and an upper bracket 155 substantially identical to the bracket 122/127 for the embodiment shown in FIGS. 4, 5 and 6 with the exception that in the embodiment shown in FIGS. 7 and 8 the upper bracket unit 155 has associated therewith the magnetically operated switch means (not shown, but similar to that shown in FIG. 3) having wires 160 and 161 connected to an alarm means 162. The rod 157 is positioned in the receiving and holding means of the brackets 156 and 155 and the top end of the rod 157 has a permanent magnet means (not shown but similar to that shown in FIG. 3) for coacting with the magnetic switch means.

Figure 9:
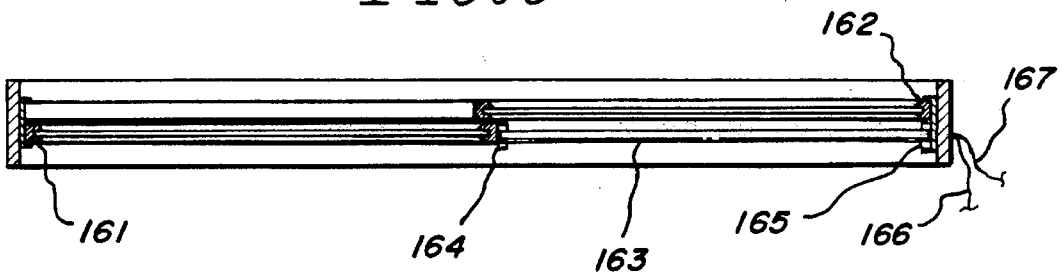
FIGS. 9 and 10 are respectively top and elevational views of a sliding window or door protected by one embodiment of my invention, FIG. 9 being as viewed along section lines 9—9 of FIG. 10.
Figure 10:
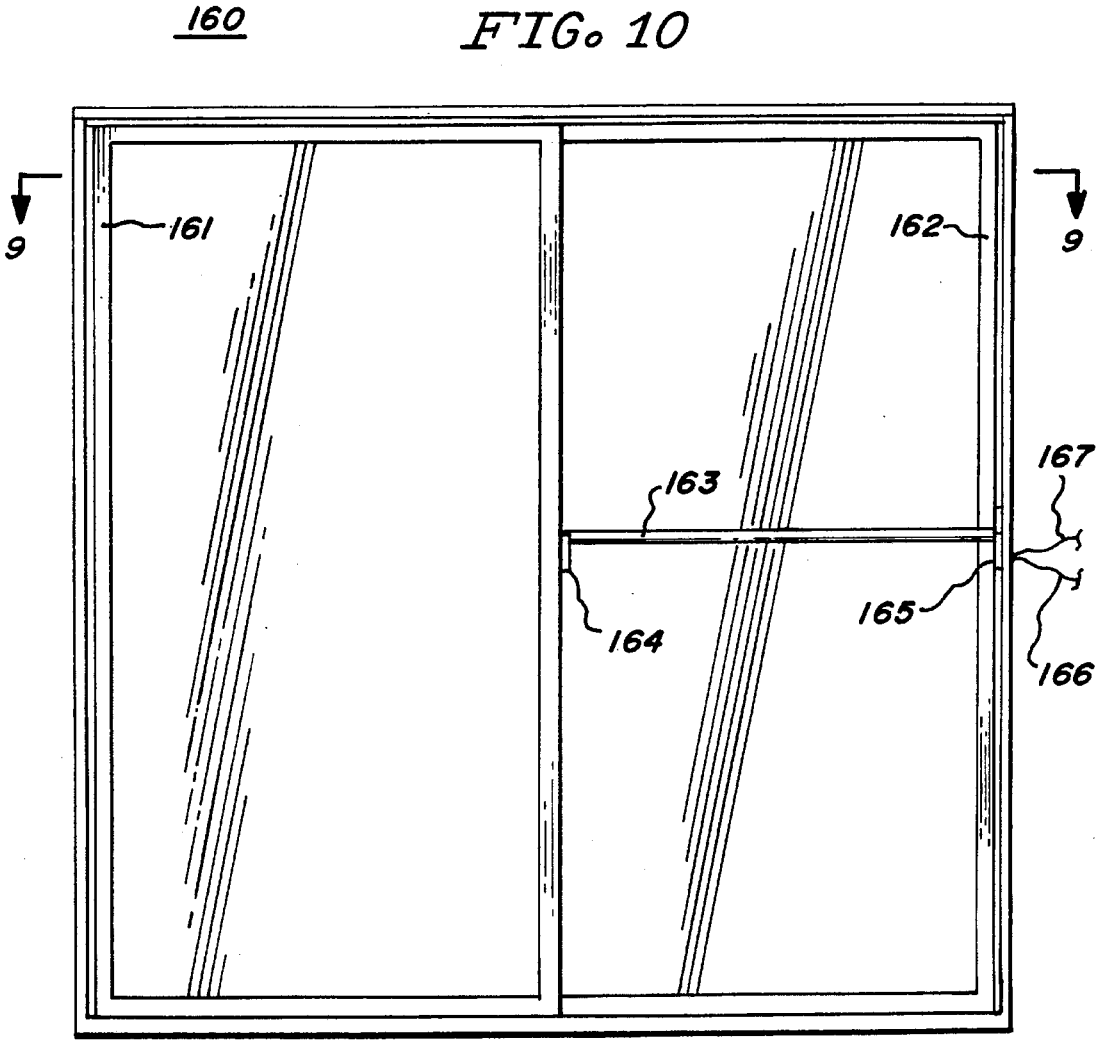

FIGS. 9 and 10 show the invention applied to a sliding window or patio door 160 having a slidable element 161 and a fixed element 162 the units 161 and 162 being assembled and an element or unit 161 being adapted for horizontal movement on upper and lower tracks. As shown in FIG. 10 the unit 161 is in its normal closed position. In the absence of some constraint, unit 161 may be moved, as shown in FIG. 10, from left to right.

However, the subject invention provides a means for securing unit 161 from such movement; this means takes the form of a rod 163 supported horizontally by a pair of brackets 164 and 165 which are essentially the same as brackets 21 and 22 as shown in FIG. 1. Again, the rod 163 has an appropriate diameter for being received in the notch of the bracket and bracket 165 has magnetically operated switch means, not shown, which coact with the magnetic field from the permanent magnet means, not shown, at the right end of rod 163 as shown in FIG. 10. The switch means would be connected by leads 166 and 167 to alarm means, not shown. Again the magnet means and magnetic switch means are similar to those used for the above first embodiment.

Figure 11:
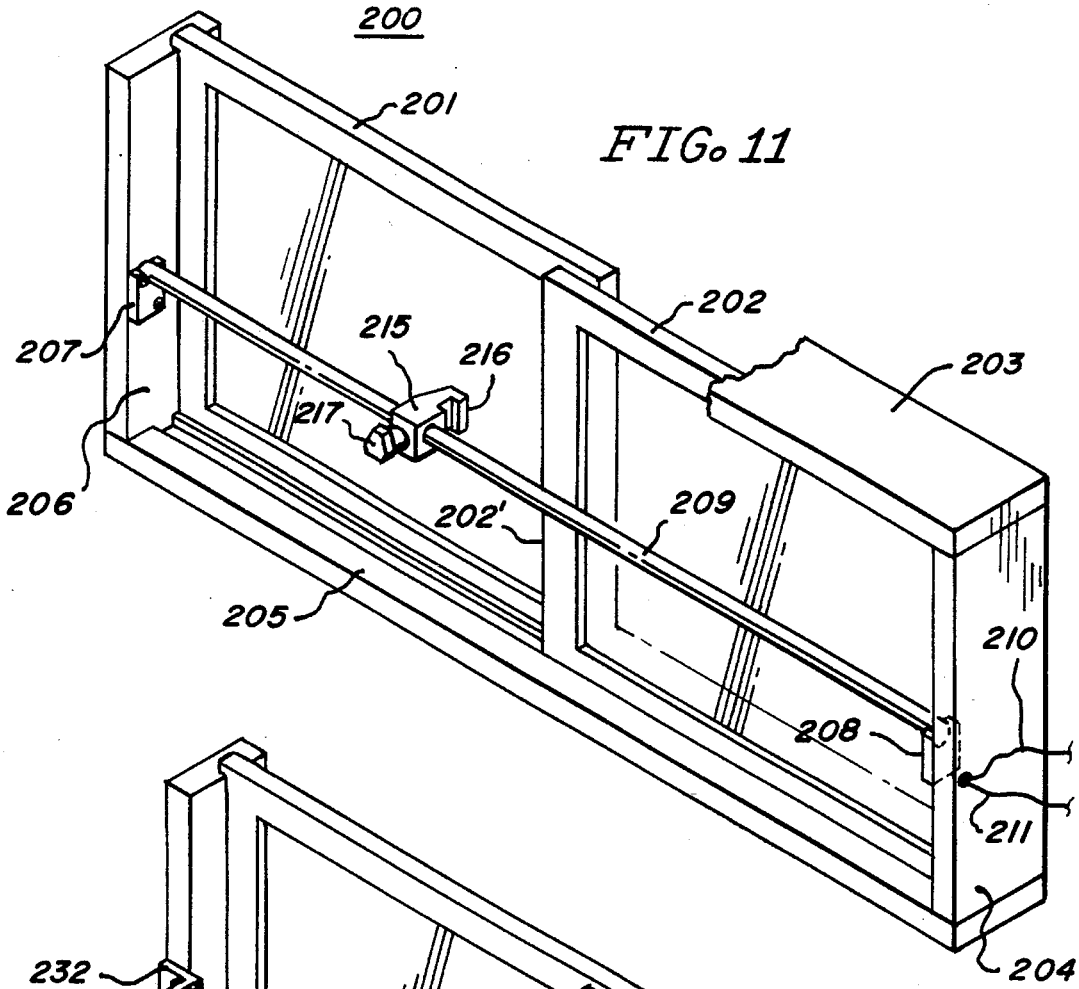
FIG. 11 is an isometric showing of another embodiment of my invention as applied to a double hung window where the movement axis is depicted as being horizontal.

FIG. 11 shows my invention applied to a different type of window 200 comprising a first window unit 201 and a second movable unit 202 which are positioned in spaced apart parallel tracks in a lower window casing member 205 for horizontal movement of unit 202 with respect to unit 201. The window casing further comprises an upper member 203, a right side member 204, and a left side member 206, all as shown in FIG. 11. Rod supporting brackets 207 and 208 are mounted as shown on the window casing members 206 and 204 respectively; the bracket members may be essentially identical to brackets 21 and 22 of FIG. 1. A rod 209 is supported by the brackets 207 and 208 and has at the right end, as shown, a permanent magnet means (not shown) coacting with a magnetically operated switch (not shown) in bracket 208. Again the magnet means and magnetic switch means are similar to those used for the above first embodiment. Leads 210 and 211 connect the switch means to alarm means, not shown.

An adjustable stop means 215 is mounted on the rod 209 to provide an adjustable stop for limiting a preselected amount of movement of window unit 202 to the left as shown in FIG. 11. The stop means 115 has an extension 216 thereon adapted to be in engagement with the left side 202' of the window unit 202. The stop means 215 may be adjusted to any appropriate longitudinal position on the rod 209 between the left side 202' of the window 202 and the window casing 206. A screw means 21 7 may be used for securing the stop means 215 to the rod 209 at any desired position.

Figure 12:
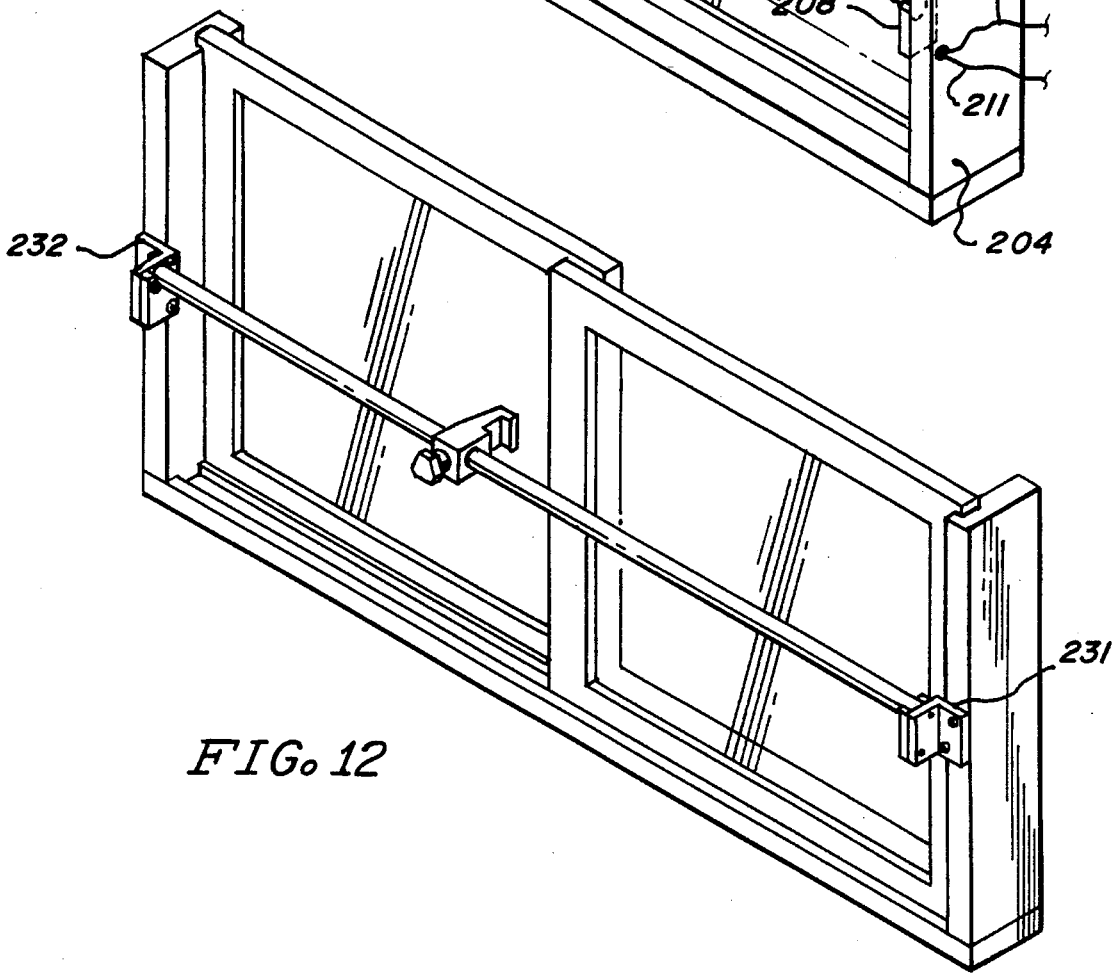
FIG. 12 is an isometric view of the same type of window as in FIG. 11, but with special bracket supports.

FIG. 12 is essentially identical to FIG. 11 with exception that the rod supporting brackets are in turn held by auxiliary bracket support means 231 and 232. These brackets are shown to be angle brackets and are useful in applications where there is not sufficient space on the window casing for the mounting of the rod supporting brackets, such as is shown in FIG. 11. In FIG. 12 there is less available space on the window casing and hence the brackets 231 and 232 may be used.

The present invention and its advantages will be understood from the foregoing description and it will be apparent that various changes may be made thereto without departing from the spirit and scope of the invention, the forms described herein being the preferred embodiments thereof. Specifically the term "window", as used in the claims should be construed to cover both windows and doors.

The embodiments of an invention in which an exclusive property or right is claimed are defined as follows:

1. Security apparatus adapted to be connected to alarm means of a building system, said apparatus further being adapted for providing two-part security for a window movably positioned in a wall of a building having a window casing and means for rotatably connecting said window to said casing so that said window may be selectively rotated about a rotational axis from a closed position to an open position, said security apparatus comprising:

a) a pair of rod holding brackets mounted, respectively, on said window casing on opposite sides of said window on an axis spaced from and substantially parallel to said rotational axis, each of said brackets having means for receiving and holding the end of a rod;

b) an elongated rod having opposite ends and a length preselected so that said rod may be supported at each of said ends by said receiving and holding means of said brackets;

c) magnet means integrally attached to one of said ends of said rod;

d) magnetically operable switch means attached to one of said brackets; and e) means for connecting said switch means to said alarm means, said apparatus being further characterized by:

(i) said rod being positioned, when said window is in said closed position, so that said ends thereof are positioned respectively on said brackets and engaging said receiving and holding means and with said magnet means positioned in magnetic proximity with said switch means to thereby cause said switch means to have a first condition;

(ii) said rod, when positioned as aforesaid, preventing said window from being moved from said closed position to said open position; and (iii) said rod, when removed from said brackets so that said magnet means is moved away from said switch means, causing a change in condition of said switch means from said first condition to a second condition to thereby actuate said alarm means of said alarm system.

2. Apparatus of claim 1 further characterized by said receiving and holding means of each of said brackets comprising a notch having a profile preselected to complement the surface of said ends of said rod.

3. Apparatus of claim 2 wherein said rod has a circular cross section and said notch has a surface curved about a radius substantially the same as one-half of the diameter of said rod.

4. Apparatus of claim 2 wherein said notches have a transverse cross-section preselected to receive snugly said rod.

5. Apparatus of claim 1 further characterized by said switch means functioning, in one of said conditions, to cause electric current to flow to and through said alarm means of said alarm system.

6. Apparatus of claim 1 wherein said rod is hollow and said magnet means is fixed within said hollow rod at one end thereof, said rod being of a low magnetic permeable material.

7. Apparatus of claim I wherein said rotational axis is substantially vertical and one of the brackets has connected thereto in abutting relation an auxiliary member having an aperture therethrough in general alignment with said receiving and holding means, said aperture being preselected so as to permit the passage therethrough of said rod.

8. Security apparatus adapted to be connected to alarm means of a building alarm system, said apparatus further being adapted for providing two-part security for a window movably positioned in a wall of a building having a window casing and means for connecting said window to said casing so that said window may be selectively moved with respect to an axis from a closed position to an open position, said security apparatus comprising:

a) a pair of rod holding brackets mounted, respectively, on said window casing on opposite sides of said window on an axis spaced from and substantially parallel to said axis, each of said brackets having means for receiving and holding the end rod;

b) an elongated rod having opposite ends and a length preselected so that said rod may be supported at each of said ends by said receiving and holding means of said brackets;

c) magnet means integrally attached to one of said ends of said rod;

d) magnetically operable switch means attached to one of said brackets; and e) means for connecting said switch means to said alarm means, said apparatus being further characterized by:

(i) said rod being positioned, when said window is in said closed position, so that said ends thereof are positioned respectively on said brackets and engaging said receiving and holding means and with said magnet means positioned in magnetic proximity with said switch means to thereby cause said switch means to have a first condition;

(ii) said rod, when positioned as aforesaid, preventing said window from being moved from said closed position to said open position; and (iii) said rod, when removed from said brackets so that said magnet means is moved away from said switch means, causing a change in condition of said switch means from said first condition to a second condition to thereby actuate said alarm means of said alarm system.

9. Apparatus of claim 8 further characterized by said receiving and holding means of each of said brackets comprising a notch having a profile preselected to complement the surface of said ends of said rod.

10. Apparatus of claim 9 wherein said rod has a circular cross-section and said notch has a surface curved about a radius substantially the same as one-half of the diameter of said rod.

11. Apparatus of claim 9 wherein said notches have a transverse cross-section preselected to receive snugly said rod.

12. Apparatus of claim 8 further characterized by said switch means functioning, in one of said conditions, to cause electric current to flow to and through said alarm means of said alarm system.

13. Apparatus of claim 8 wherein said rod is hollow and said magnet means is fixed within said hollow rod at one end thereof, said rod being of a low magnetic permeable material.

14. Apparatus of claim 8 wherein said window axis is substantially vertical and one of the brackets has connected thereto in abutting relation an auxiliary member having an aperture therethrough in general alignment with said receiving and holding means, said aperture being preselected to as to permit the passage therethrough of said rod.

15. Apparatus of claim 8 further characterized by including stopping means mounted on said rod and adjustable along the longitudinal extent of said rod, said stopping means including a portion adapted to contact the window as it moves along said axis.

* * * * *